US005085745A

United States Patent [19]

Farber et al.

[11] Patent Number: 5,085,745

[45] Date of Patent: Feb. 4, 1992

[54] METHOD FOR TREATING CARBON STEEL CYLINDER

[75] Inventors: Scott A. Farber, Chicago, Ill.; Francis V. Bellafiore, Louisville, Ky.

[73] Assignee: Liquid Carbonic Corporation, Chicago, Ill.

[21] Appl. No.: 610,259

[22] Filed: Nov. 7, 1990

[51] Int. Cl.[5] ..... C25F 1/00; C25F 3/06; C25F 3/24

[52] U.S. Cl. ..... 204/129.35; 204/129.9; 204/129.95; 204/141.5

[58] Field of Search ..... 204/129.1, 129.35, 129.55, 204/129.95, 129.9, 141.5, 26, 34, 37.1

[56] References Cited

U.S. PATENT DOCUMENTS

| | | | |
|---|---|---|---|
| 2,048,578 | 7/1936 | Vander Horst | 204/26 |
| 2,314,604 | 3/1943 | Vander Horst | 204/26 |
| 2,475,586 | 7/1949 | Bartlett | 204/129.9 X |
| 2,935,455 | 5/1960 | Swagler | 204/129.9 |
| 2,980,593 | 4/1961 | Larson | 204/26 |
| 3,726,773 | 4/1973 | Lamb et al. | 204/129.9 X |
| 4,372,831 | 2/1983 | Rosswag | 204/129.95 X |
| 4,772,337 | 9/1988 | Kesten | 204/129.1 X |

*Primary Examiner*—Donald R. Valentine
*Attorney, Agent, or Firm*—Fitch, Even, Tabin & Flannery

[57] ABSTRACT

The present invention is directed to a method for providing substantially particulate free gases by dispensing a highly pressurized gas from a carbon steel cylinder. The carbon steel cylinder is made by a process comprising the steps of forming an open ended cylinder from a billet, blank or tube of carbon steel. The side walls of the cylinder are made thicker than the desired final thickness of the cylinder side wall. One end of the cylinder is closed. The interior of the cylinder side walls is then honed to remove at least some of the excess side wall thickness. A tapered neck is then formed and tapped in the open end of the cylinder. The interior surface of the cylinder is then electropolished with a chromium rich electroplating solution to provide a surface layer with reduced iron and increased carbon and chromium on the interior surface wall of the cylinder. The cylinder may then be vacuum baked to reduce adsorbed contamination.

8 Claims, 1 Drawing Sheet

METHOD FOR TREATING CARBON STEEL CYLINDER

FIELD OF THE INVENTION

The present invention is directed to a method for providing substantially particulate free gases from a carbon steel cylinder suitable for the containment of a gas under high pressure. The cylinder has an interior surface which has been treated to provide an extremely clean inert surface having low particulate generation and entrapment qualities. The cylinder is particularly suitable to supply very high purity gases for specialty users, such as in the semiconductor processing industry.

BACKGROUND OF THE INVENTION

Stainless steel and aluminum cylinders have long been used for the provision of gases where high purity is a requirement. Stainless steel cylinders, however, are extremely expensive and are difficult to manufacture. Aluminum cylinders provide a clean inert inner surface, but they lack the capacity of carbon steel or stainless steel cylinders and they are associated with cracking where the aluminum is drawn down to provide the cylinder neck.

The present invention utilizes an interior surface finishing process for carbon steel cylinders to provide the benefits of the present invention with respect to very low particulate generation and entrapment properties. In the first step, the interior surface of the cylinder is honed to provide a relatively smooth surface. The interior surface of the cylinder is then electropolished to provide unique surface chemistry and the properties of the invention with respect to cleanliness and low particulate generation and entrapment. In an important embodiment, a vacuum baking step can then be used to eliminate adsorbed impurities and moisture.

It is well known to treat the surface of various metals by electropolishing. U.S. Pat. No. 3,919,061 to Jumer is directed to a method and apparatus for electropolishing or chemical polishing of the entire inner surface of a large cylindrical vessel having at least one closed end. U.S. Pat. No. 3,682,799 to Jumer is also directed to a method for fabricating cylindrical vessels having domed or necked ends wherein the interior surfaces of the vessel including the access ports are provided with an electropolished surface.

U.S. Pat. No. 3,795,597 to Katz, et al. is directed to a method for producing an ultraclean, bright surface on titanium. The method involves treating the titanium surface with a solution of methyl alcohol, sulfuric acid and hydrochloric acid and through which is passed an electric current.

A method for transferring very pure ultimate use gas from a cylinder to a user apparatus through a tube fitted with valves and other distributing and control elements is described in U.S. Pat. No. 3,880,681 to Sifre, et al. In the method, the tubing, valves and other elements are subjected before the transferring and before assembly as a flow line to chemical etching by aqueous solutions of volatile noncontaminating acids, then to decontamination by extensive sweeping with a very pure hot gas to volatilize the acids. The ultimate use gas is subsequently transferred after assembly and additional sweeping by pure hot gas through the decontaminated tubing, valves and other elements to the ultimate user apparatus.

An apparatus for internally electropolishing tubes is described in U.S. Pat. No. 4,705,611 to Grimes. In the apparatus, a plurality of elongated tubes are horizontally supported and rotatably driven about their axes. An outlet fitting including an end dam permits rotation of the tube outlet end and allows escape of gases from the upper portion of the tube to permit overflow of electrolyte liquid thereover.

U.S. Pat. No. 2,412,186 to Whitehouse describes a method of electrolytic polishing to provide a bright surface on the interior of stainless steel tubes.

U.S. Pat. No. 3,405,049 to Czubak is directed to a rotary boring tool including a plurality of cutting tools for performing different cutting operations on a single tool spindle. The rotary boring tool is used for both rough cutting and honing wherein a generally cylindrical bore is sized and finished to close tolerances. The bore is first enlarged or roughed out slightly undersized by a roughing cutter and a finishing cutter designed to remove a relatively small amount of stock is used to accurately size the work piece bore. A honing tool is then used to finish the bore to a high degree of precision and impart a desired surface finish to the bore wall. The Czubak patent describes a single tool which can be used for all of these operations. The Czubak patent indicates that the honing tool assembly may incorporate the use of an electrolytic assist in honing the cylindrical bore by placing contoured electroplates connected to a source of electric current which are disposed in spaced circumferential relation to a spindle. When using the electrolytic assist, fluid is dispersed through the spindle to the workpiece bore through fluid distributing openings.

While various means and apparatus for treating the interior surface of cylindrical objects are known, it would be desirable to provide a means for providing a very highly polished surface on the interior of carbon steel cylinders intended for use in containing a user gas of very high purity under high pressure and providing the user gas for specialized operations, such as semiconductor manufacturing processes. As indicated, the use of stainless steel cylinders for such purposes is very expensive and the use of aluminum cylinders is not practical due to structural problems incurred while providing the necessary tapered neck in the end of the cylinder.

Accordingly, it is a principal object of the present invention to provide a method for distributing a substantially particulate free gas wherein the cylinder containing the gas is provided with a smooth, inert surface of unique chemical composition.

It is another object of the present invention to provide a method for dispensing a highly pressurized gas from a carbon steel cylinder wherein the gas is dispensed in a substantially particulate and contaminant free form.

These and other objects of the present invention will become more apparent from the following detailed description and the accompanying drawings.

SUMMARY OF THE INVENTION

Figure 1:
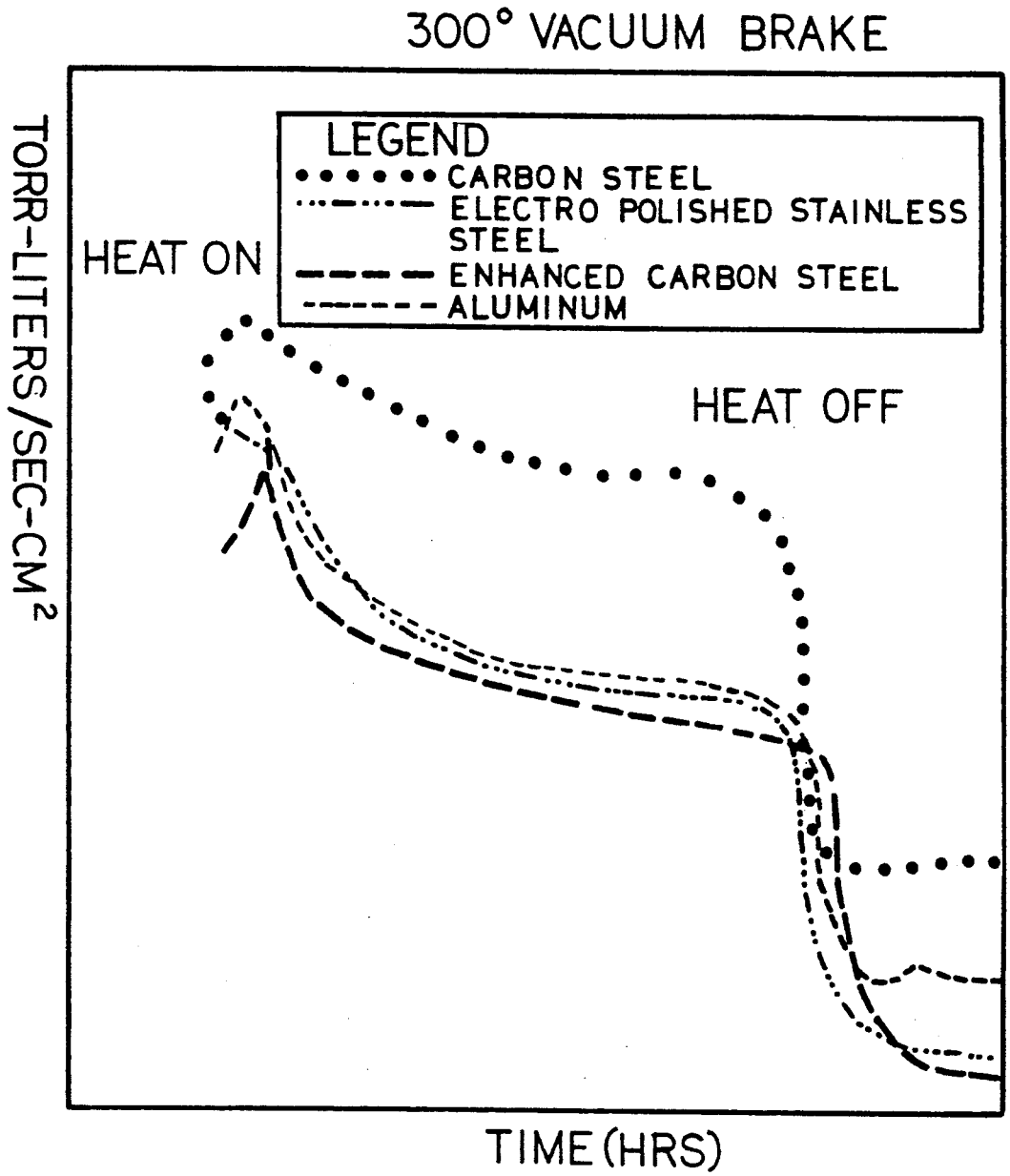
FIG. 1 is a plot comparing the outgassing properties of the carbon steel cylinder treated by the method of the present invention with the outgassing properties of electropolished stainless steel, plain carbon steel and aluminum.

The present invention is directed to a method for providing substantially particulate free gases by dispensing a highly pressurized gas from a carbon steel cylinder. The carbon steel cylinder is made by a process comprising the steps of forming an open ended cylinder from a billet, blank or tube of carbon steel. The side walls of the cylinder are made thicker than the desired final thickness of the cylinder side wall. One end of the cylinder is closed if both ends are open at this point in the process of forming the cylinders. The interior of the cylinder side walls is then honed to remove at least some of the excess side wall thickness. A tapered neck is then formed and tapped in the open end of the cylinder. The interior surface of the cylinder is then electropolished with a chromium rich electroplating solution to provide a surface layer with reduced iron and increased carbon and chromium on the interior surface wall of the cylinder. The cylinder may then be vacuum baked to reduce adsorbed contamination.

DETAILED DESCRIPTION OF THE INVENTION

A steel billet was used to prepare an open ended cylinder in accordance with the present invention. The steel is normal carbon steel having a composition of from about 0.25% to about 0.35% carbon, from about 0.40% to about 0.90% manganese, less than 0.4% phosphorous and less than 0.5% sulfur. This corresponds to steel having an E.I.S.I. number of 4130. The dimensions of the steel cylinder corresponds to that required for a DOT 3AA2400 carbon steel cylinder and these dimensions are 7–10 inches in diameter by 36–52 inches long and having a wall thickness that corresponds to the following DOT specifications:

$$S = \frac{P(1.3D^2 + 0.4d^2)}{D^2 - d^2}$$

where:

S = wall stress in pounds per square inch: (not over 70,000 psi)

P = minimum test pressure prescribed for water jacket test or 450 pounds per square inch whichever is greater:

D = outside diameter in inches.

d = inside diameter in inches.

In accordance with the invention, the wall thickness of the initial cylinder was 0.05 inches greater than those required for the final cylinder.

After the initial piercing of a steel billet, or drawing and ironing of a steel blank or spinning one end of a tube, an open ended cylinder is formed which in the normal course of manufacturing a steel cylinder for containing high pressure gases would be spun to provide a narrowed neck and would be tapped to provide a means for attaching a cap or a pressure gauge or valve. At this time, the steel cylinder shell is removed from the normal process and is honed on the interior surface using a mandrel provided with a 180 grit or finer grinding surface. From about 0.01 to about 0.03 inches of material are honed from the interior surface of the shell.

The cylinder is then returned to the normal manufacturing process and the tapped neck is provided in the cylinder. Normal heat treatment conditions are then used to finish forming the cylinder. The cylinder is then hydrostatically tested to confirm that no cracks have been formed during the manufacturing process.

The interior surface wall of the cylinder is then treated by an electropolishing treatment to provide the unique surface chemistry of the invention. A fitting is provided for the cylinder which can be screwed into the cap threads of the cylinder. The fitting comprises a cathode rod which extends to the bottom of the cylinder. The cathode is preferably made of carbon, but any suitable material such as copper can be used for the cathode. The fitting is provided with inlet and outlet fittings for passage of an electrolyte into and out of the cylinder. The electrolyte solution is introduced to the interior of the cylinder either by submersion in a bath or by flowing into the cylinder by use of a conduit.

The electrolyte solution is a mixture of chromic acid and phosphoric acid. The chromic acid is preferably present in the electrolyte at a level of from about 5% to about 20% and the phosphoric acid is preferably present in the electrolyte at a level of from about 80% to about 95%. If a flow configuration is used, the electrolyte is flowed through the cylinder at a rate of 0.5 to about 1.0 gallons per minute. All percentages used herein are by weight and all temperatures are in degrees Fahrenheit, unless otherwise indicated.

Electropolishing, of course, is a method for polishing metal surfaces by applying an electric current through an electrolytic bath in a process that is the reverse of plating. The metal to be polished is made the anode in an electric circuit. Anodic dissolution of protuberant asperities, such as burrs and sharp edges occurs at a faster rate than the removal of asperities from the flat surfaces and crevices, possibly because of locally higher current densities. In accordance with the present invention, a current density of from about 10 to about 30 amps per square foot is utilized. The electrolyte is maintained at a temperature of from about 140° F. to about 200° F.

The electrolyte used in the electropolishing step of the present invention is essentially an electroplating electrolyte and is not the type of electrolyte normally used in the electropolishing of steel. Normally, steel is electropolished with sulfuric acid and phosphoric acid to which some chromic or humic acids may be added. The electroplating type chromium electrolyte used in accordance with the present invention results in producing a surface chemistry that is unusual for an electroplishing type of operation. Three samples of the cylinders produced by the method of the present invention were analyzed for surface chemistry and for chemistry at a depth of 70 Angstroms from the surface. The cylinders were prepared from carbon steel having 0.30% carbon and 0.9% chromium. The three samples produced surface chemistries in accordance with the following table:

TABLE 1

Elemental Composition of Steel Cylinder Surface

| Sample | Element (at %) | | | | | | |
|---|---|---|---|---|---|---|---|
| | Fe | Cr | O | C | Na | P | Ca |
| 1 - Surface | 40.8 | 5.8 | 35.7 | 10.5 | 3.8 | 3.4 | — |
| 1 - 70Å Depth | 74.2 | 5.5 | 15.0 | 1.3 | 1.2 | 1.5 | 1.4 |
| 2 - Surface | 46.2 | 4.2 | 33.8 | 7.6 | 2.7 | 3.4 | 2.1 |
| 2 - 70Å Depth | 76.2 | 4.3 | 11.7 | 3.3 | 1.3 | 1.2 | 2.0 |
| 3 - Surface | 47.2 | 3.8 | 29.6 | 10.0 | 4.4 | 3.5 | 1.5 |
| 3 - 70Å Depth | 70.7 | 5.1 | 17.0 | 1.8 | 1.8 | 1.6 | 2.0 |

As can be seen, the percentage of iron was substantially reduced at the surface and at a depth of 70 Angstroms, whereas the percentage of chromium, oxygen, carbon, sodium and phosphorous was substantially increased over that of the initial steel. This means that some chromium from the electroplating solution is being deposited in some form onto the surface of the cylinder during the electropolishing operation. It is believed that this altered surface chemistry extends to a depth of about 200 Angstroms. This is not to be expected since the cylinder serves as the anode in the electropolishing operation and it would be expected that the chromium would be deposited on the cathode. The increase in carbon and phosphorous is probably due to the selective removal of iron during the electropolishing step. The result of the electropolishing step provides a surface chemistry totally unlike that of normal stainless or carbon steels. Normally, stainless steel has a minimum of 6% chromium and normal carbon steels have a maximum of 0.04% phosphorous and a maximum of 2% carbon. Most stainless and carbon steels have less than 1% carbon. While not wishing to be bound by any theory, it is believed that the unexpected and unique surface chemistry of the carbon steel cylinders used for the electropolishing step of the present invention, provide the outstanding properties of the finished cylinder with respect to outgassing.

Gassing tests were conducted utilizing the cylinders treated in accordance with the present invention and were compared with electropolished stainless steel cylinders, normal carbon steel cylinders and aluminum cylinders. The results of the outgassing tests are shown in FIG. 1. In the outgassing tests, each cylinder was heated to a temperature of 300° F. while a vacuum of $10^{-9}$ torr was pulled on the cylinder. Any rise in pressure (decrease in vacuum) indicates that trace amounts of contaminants, such as moisture and hydrocarbons, which had been trapped on the cylinder walls was boiling off. The smoothest surface is, of course, less likely to entrap contaminants. The test results, shown in FIG. 1, indicate that the carbon steel cylinder treated in accordance with the present invention is equal or slightly better than stainless steel in respect to outgassing and is superior to aluminum and regular carbon steel. The use of a vacuum baking step at a temperature of from about 250° F. to about 350° F. at a vacuum of from about $10^{-8}$ to about $10^{-10}$ for a period of from about 8 to about 16 hours is an important embodiment of the method of the present invention for treating carbon steel cylinders to provide an extremely clean, inert surface.

Particulate generation tests were conducted to measure the amount of particulates generated by different cylinder types.

These tests show that the carbon steel cylinder treated in accordance with the method of the invention is slightly lower in particles generated than aluminum and is far superior to stainless and carbon steel. The tests were conducted by rinsing out the cylinders with freon, evacuating the cylinder, filling it with nitrogen and venting it through a condensation nucleus particle counter.

The carbon steel cylinders treated in accordance with the method of the present invention provide a unique means for dispensing a high purity gas for special operations.

While the invention has been described with respect to various parameters and components, the invention should not be considered to be measured in terms of these components, but is instead defined in the appended claims.

What is claimed is:

1. A method for providing substantially particulate free gases comprising dispensing a highly pressurized gas from a carbon steel cylinder wherein said cylinder has been made by a process comprising the steps of forming an open ended cylinder from carbon steel, the side walls of said cylinder being thicker than the desired final thickness of said cylinder side walls, honing the interior of said cylinder side walls to remove at least some of said excess side wall thickness, forming and tapping a tapered neck in said open end of said cylinder and electropolishing the interior of said cylinder with a chromium rich electroplating solution to provide a surface layer extending to a depth of about 200 Angstroms and wherein the carbon level in said surface layer is at least about 1 percent, the chromium level is at least about 3 percent and the iron content is less than about 80 percent.

2. A method in accordance with claim 1 wherein said honing step removes from about 0.01 to about 0.03 inches from the interior surface of said cylinder.

3. A method in accordance with claim 1 wherein said cylinder is subjected to vacuum baking after said electropolishing step.

4. A method in accordance with claim 3 wherein vacuum baking is at a temperature of from about 250° F. to about 350° F. at a pressure of from about $10^{-8}$ to about $10^{-10}$ torr for a time of from about 8 to about 16 hours.

5. A method for treating a carbon steel cylinder to provide a smooth, inert, substantially particulate free inner surface comprising the steps of forming an open ended cylinder from carbon steel, the side walls of said cylinder being thicker than the desired final thickness of said cylinder side walls, honing the interior of said cylinder side walls to remove at least some of said excess side wall thickness, forming and tapping a tapered neck in said open end of said cylinder and electropolishing the interior of said cylinder with a chromium rich electroplating solution to provide a surface layer extending to a depth of about 200 Angstroms and wherein the carbon level in said surface layer is at least about 1 percent, the chromium level is at least about 3 percent and the iron content is less than about 80 percent.

6. A method is accordance with claim 5 wherein said honing step removes from about 0.01 to about 0.03 inches from the interior surface of said cylinder.

7. A method in accordance with claim 5 wherein said cylinder is subjected to vacuum baking after said electropolishing step.

8. A method in accordance with claim 7 wherein vacuum baking is at a temperature of from about 250° F. to about 350° F. at a pressure of from about $10^{-8}$ to about $10^{-10}$ torr for a time of from about 8 to about 16 hours.

* * * * *